United States Patent [19]

Cordova et al.

[11] 4,280,643

[45] Jul. 28, 1981

[54] CAMPING CLEAN-UP EQUIPMENT CENTER

[76] Inventors: Sam Cordova; Stella Cordova, both of 13345 Gridley St., Sylmar, Calif. 91342

[21] Appl. No.: 86,310

[22] Filed: Oct. 19, 1979

[51] Int. Cl.[3] ..... A45F 3/16; A47K 3/23

[52] U.S. Cl. ..... 294/141; 4/602; 4/612; 4/617; 206/77.1; 206/225; 206/581; 222/181; 224/148; 294/146

[58] Field of Search ..... 224/45 R, 46 R, 148; 222/181, 185; 132/79 R; 4/602, 603, 612, 617, 661, 330.1, 460; 206/223, 581, 225, 0.5, 77.1, 217

[56] References Cited

U.S. PATENT DOCUMENTS

| | | | |
|---|---|---|---|
| 1,104,314 | 7/1914 | Rench | 4/602 X |
| 1,398,208 | 11/1921 | Trial | 4/617 |
| 1,636,186 | 7/1927 | Hickson | 4/602 X |
| 1,742,279 | 1/1930 | Reynolds | 206/581 X |
| 1,902,548 | 3/1933 | Fenwick, Jr. | 224/148 X |
| 2,350,184 | 5/1944 | Oys | 224/148 X |
| 2,403,430 | 7/1946 | Andrews et al. | 4/617 |
| 4,113,149 | 9/1978 | Harsch | 222/181 |
| 4,193,518 | 3/1980 | Holmes | 224/148 X |

FOREIGN PATENT DOCUMENTS

| | | | |
|---|---|---|---|
| 954255 | 12/1949 | France | 4/602 |
| 397126 | 2/1966 | Switzerland | 206/0.5 |

*Primary Examiner*—Stephen Marcus

*Attorney, Agent, or Firm*—Jacob H. Steinberg

[57] ABSTRACT

Portable camping clean-up equipment center is provided that can be shoulder carried, hung by a tree branch, or placed on a table or in a car comprising a central container which can be filled with water to which are disposably attached a cup holder, a paper towel holder, a soap holder, and a trash holder and in addition is provided with valve controlled faucet and a valved shower head.

6 Claims, 5 Drawing Figures

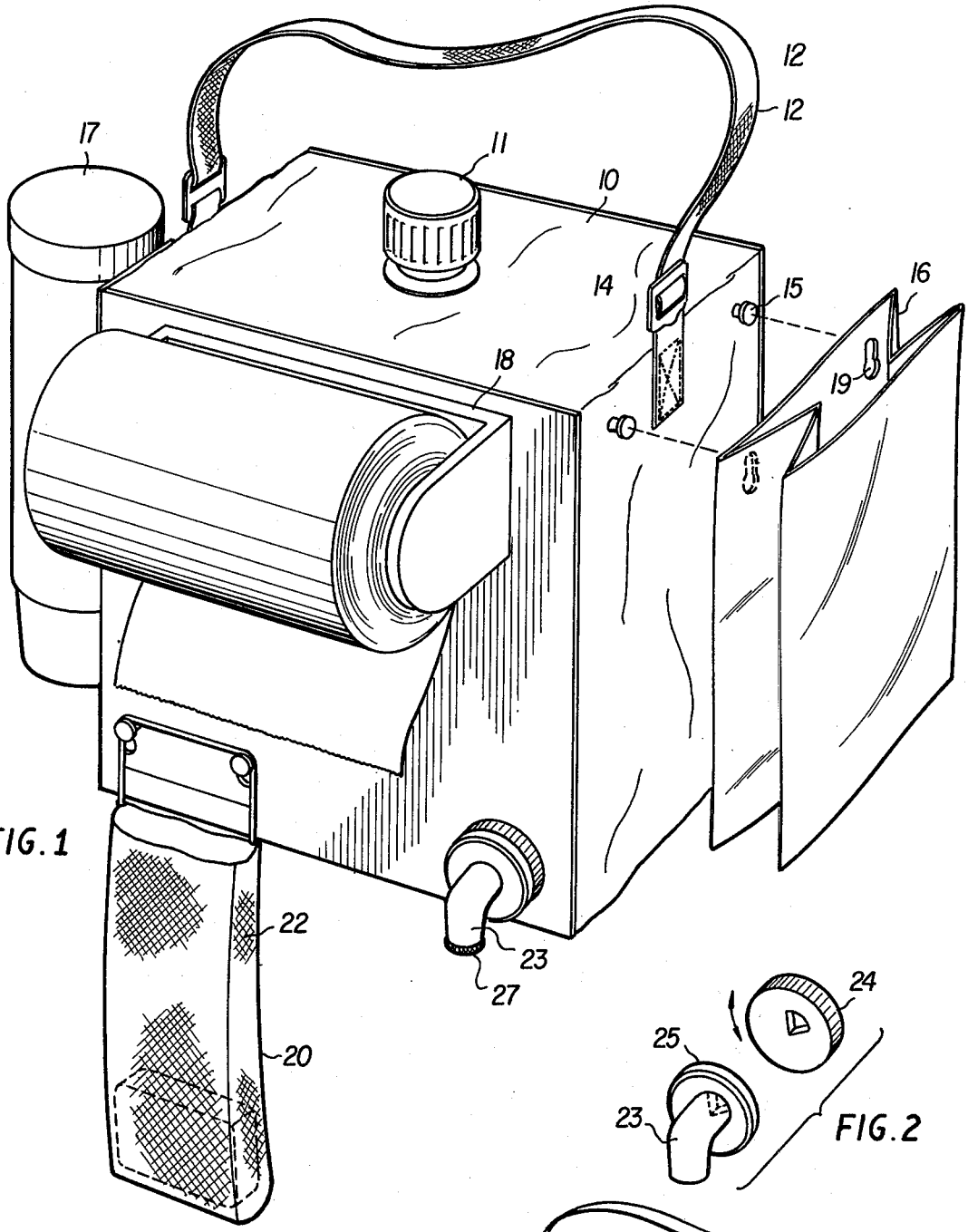
FIG. 1
FIG. 2
FIG. 3
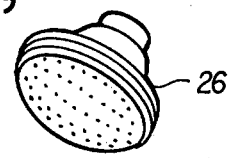
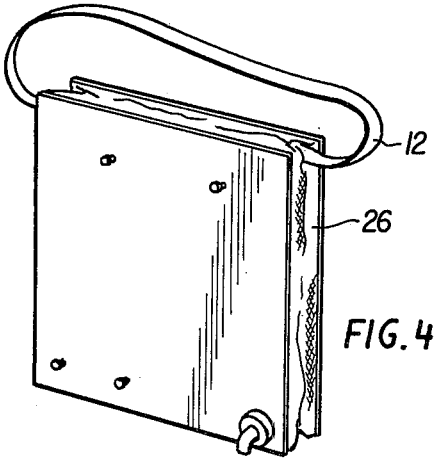
FIG. 4

CAMPING CLEAN-UP EQUIPMENT CENTER

The present invention provides novel clean up center equipment means for use by hikers where rest rooms are not available for drinking and washing facilities.

Although hand carried tanks have been available for providing drinking water at building sites, no device has been made available to include washing facilities which are very essential for hikers.

An object of this invention is to provide a light weight, portable, clean up center combination which can be carried, hung up by an adjustable strap, or set on a table or in a car.

A further object is to provide a tank for containing water, which is square to provide for three sides to carry a rack to hold towel paper, a trash holding bag, and a holder for soap, all disposably hung by means of pegs.

Another object is to provide medial foldable sides for compact carrying purposes.

Another object is to provide a twofold combination that can be used for washing as well as for drinking.

Another object is to avoid littering in the clean up process.

Another object is to provide for a sanitary soap holding container.

Another object is to use peg mounting means for facile use and replenishment of the items used in conjunction with the water dispenser.

A further object of this invention is to provide a clean up center of the foregoing character which is of relatively simple construction, relatively inexpensive to manufacture, of relatively light weight and of durable material, as well as being attractive in appearance, whether hung on a tree branch or placed on a table.

The foregoing and other objects will appear from the following description and appended claims when considered in connection with the accompanying drawing forming a part of this specification.

In the accompanying drawings there has been disclosed a structure designed to carry out the various objects of this invention, but it is to be understood that the invention is not confined to the exact features shown as various changes may be made within the scope of the claims.

IN THE DRAWINGS

FIG. 1 is a perspective view showing the essential structure of the camping clean-up center equipment;

FIG. 2 shows the operation of the valve to control the water flow;

FIG. 3 shows a valve controlled shower head centrally located in the bottom side of the container; and FIG. 4 shows the foldable sides for compact carrying.

Figure 5:
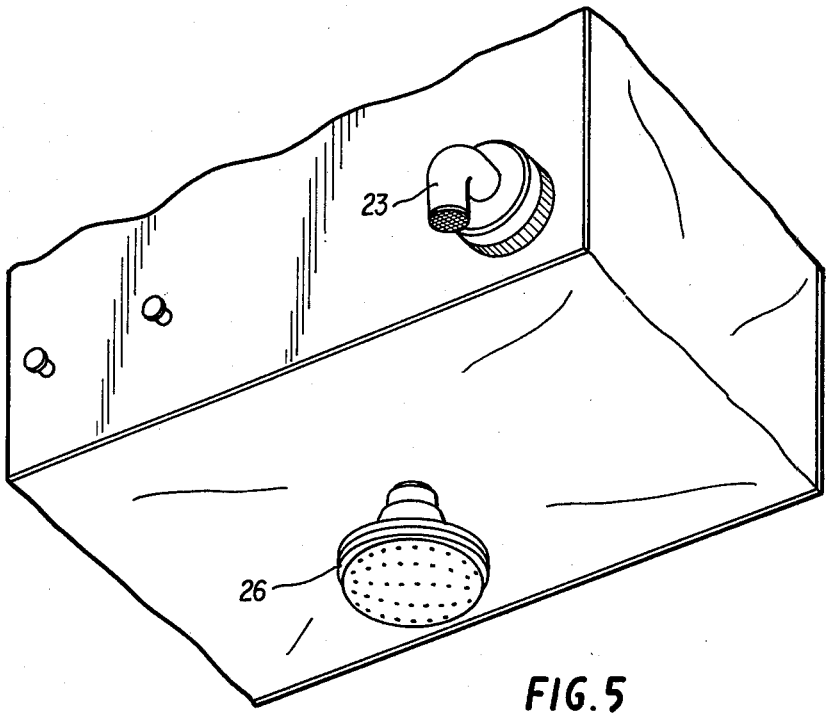
FIG. 5 shows a perspective view of the bottom wall broken away to show the location of both the shower and the faucet.

The novel camping clean up center equipment herein disclosed, shows a water container 10 which has a capacity of approximately 7 and ¾ gallons. The container shown is square and measures 8 by 16 inches on all sides. The top contains an opening that is sealed with a cap 11. Heavy web strapping 12 is used as a carrier for the equipment. The use of two buckles 14 enables the user to adjust the strap for proper carrying or for hanging on a tree branch. When the equipment is hung from a tree branch, use of the buckles enables one end of the strap to be unfastened, placing the strap over the branch, and then fastening the strap snugly thereto. On one side panel, pegs 15 are provided on which a disposable trash bag 16 is mounted by slipping the pegs through openings located on the back panel of the bag. The openings 19 are shaped like numeral 8 which has a small circle on top and a large circle on the bottom. On the opposite side panel there is similarly mounted a paper cup dispenser 17. The front panel is provided with washing and drinking facilities. At the top of the front panel a towel paper holder 18 is provided for carrying a roll of paper and it is similarly mounted as is bag 16. At the lower left hand side of the front panel, a disposably mounted soap holder 20, similarly hung as bag 16, is provided and it includes a metal frame 21 to which is attached a cloth mesh cover 22. The soap holder can be filled with either a soap bar or folded reinforced cellulosic webbing impregnated with a soapy solution. Such a webbing could serve as a disposable wash cloth for better clean up purposes. At the right hand corner bottom of the front panel, a faucet 23 is provided wherein the flow of water can be controlled, as shown in FIG. 2, by valve means which includes a back plate 24, shaped to fit within the area of the back portion of the faucet and having a V shaped opening therein and a second plate similarly shaped and with a similarly shaped opening. When the plates are adjusted so that the openings are aligned the water flows freely. When the openings are misaligned, the flow is restricted or completely shut off. In FIG. 3, there is shown a valve controlled shower head 26 which is located in the center of the bottom panel of the container as is clearly shown in FIG. 5. Since the shower head is provided with similar valve structure as in the faucet, except that multiple small openings are provided, by moving one of the valve members, the amount of water can be controlled. A camper could get substantial relief by wetting his head with a supply of water.

In the event that the source of water includes river water or tap water, that would be benefited by first being strained, it is contemplated to provide a conventional strainer 27 screwed on the mouth of the faucet. This would provide the camper with potable and drinkable water.

In FIG. 4, there is shown the use of heavy waterproof canvas 26 for making some of the panels foldable, causing a reduction in size for facility in carrying the equipment. However, it is pointed out that the compositions used to make the equipment could be light weight metals such as aluminum or alloys thereof, thermoplastic or thermosetting resins, or cellulosic materials.

This novel camping clean up center equipment has been found to be extremely useful to hikers who do not have a comfort station available for clean up purposes or for providing drinking or potable water. The means provided is not only hygienic but also prevents littering by providing a disposable trash bag that will contain discarded towel paper, wash rags, cups, and garbage left from eating. In addition, this equipment can be used on any long motor trip in areas where there are no rest room facilities. Most hikers and motorists prefer their own personal equipment for wash up and drink purposes.

The peg mounting arrangement provides more personal usage. By the ease with which the replenishments of the items used with the water container can be made, each user can start with a fresh supply of the various items that are to be used.

It will be apparent to those skilled in the art that I have accomplished at least the principal objects of my invention, and it will also be apparent to those skilled in the art that the embodiments herein described may be variously changed and modified, without departing from the spirit of the invention, and that the invention is capable of uses and has advantages not herein specifically described. It will be appreciated that the herein disclosed embodiments are illustrative only, and that my invention is not limited thereto.

I claim:

1. Portable camping clean-up center comprising:

(a) an essentially square container for water, (b) said container comprised of a plurality of wall panels, (c) mounting pegs disposed on at least some of said wall panels, (d) said mounting pegs securing a disposable trash bag, a cylindrical holder for a plurality of disposable cups, a rack for removably retaining a roll of disposable towels, and a mesh bag for disposably holding soap to respective ones of said panels, (e) a faucet for dispensing water from said container, and (f) a shower head for dispensing a showerof water from said container, said shower head being mounted on a lower horizontal one of said wall panels.

2. The device of claim 1 wherein a two buckle strap is attached to the top sides of opposite wall panels.

3. The device of claim 1 wherein some sides are constructed of foldable material for ease in carrying.

4. The device of claim 1 wherein valve means are provided for control of water flow from the faucet and from the shower head.

5. The device of claim 1 wherein the said water faucet is provided with a strainer.

6. The device of claim 1 wherein the back wall panel of each of the enumerated structures are provided with openings that are aligned for hanging on said pegs.

* * * * *